US009366254B2

(12) United States Patent
Murakami

(10) Patent No.: US 9,366,254 B2
(45) Date of Patent: Jun. 14, 2016

(54) VEHICULAR SCROLL COMPRESSOR HAVING HOUSING ARRANGEMENTS FOR IMPROVED VIBRATION ISOLATION

(75) Inventor: Kazuo Murakami, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 115 days.

(21) Appl. No.: 13/416,878

(22) Filed: Mar. 9, 2012

(65) Prior Publication Data

US 2012/0237381 A1 Sep. 20, 2012

(30) Foreign Application Priority Data

Mar. 14, 2011 (JP) ..... 2011-055207

(51) Int. Cl.

| | |
|---|---|
| ***F04C 18/02*** | (2006.01) |
| ***F04C 23/00*** | (2006.01) |
| ***F04C 29/06*** | (2006.01) |
| ***F01C 21/10*** | (2006.01) |

(52) U.S. Cl.

CPC ..... *F04C 18/0215* (2013.01); *F01C 21/10* (2013.01); *F04C 23/008* (2013.01); *F04C 29/068* (2013.01); *F04C 2270/12* (2013.01)

(58) Field of Classification Search

USPC ..... 418/55.1, 55.2; 417/363, 553

See application file for complete search history.

(56) References Cited

U.S. PATENT DOCUMENTS

| | | | | |
|---|---|---|---|---|
| 4,259,043 | A * | 3/1981 | Hidden et al. | 418/55.3 |
| 5,980,222 | A * | 11/1999 | Fry | 417/553 |
| 6,017,203 | A | 1/2000 | Sugawa et al. | |
| 6,312,235 | B1 | 11/2001 | Takeuchi et al. | |
| 6,786,707 | B2 * | 9/2004 | Kim | 417/363 |
| 7,563,510 | B2 * | 7/2009 | Nogawa et al. | 428/421 |
| 2007/0031275 | A1 | 2/2007 | Nogawa et al. | |
| 2007/0104603 | A1 | 5/2007 | Zhou et al. | |
| 2007/0231173 | A1 * | 10/2007 | Ishikawa | 418/55.2 |

(Continued)

FOREIGN PATENT DOCUMENTS

| | | | |
|---|---|---|---|
| CN | 1141394 | A | 1/1997 |
| CN | 1510298 | A | 7/2004 |

(Continued)

OTHER PUBLICATIONS

English Machine Translation of JP 2009-293523 A, translation made on Mar. 14, 2014.*

(Continued)

*Primary Examiner* — Jorge Pereiro
*Assistant Examiner* — Paul Thiede
(74) *Attorney, Agent, or Firm* — Sughrue Mion, PLLC

(57) ABSTRACT

A scroll-type compressor for a vehicle, comprising a housing, a fixed scroll and a movable scroll provided in the housing, and a drive mechanism that is provided in the housing and that drives the movable scroll in a manner that disables rotating and enables orbit, by rotation of a drive shaft supported at a front end and a rear end by a front bearing device and a rear bearing device, is provided. The housing includes a first housing, a second housing and a third housing. The compressor includes a vibration isolator that is provided between the movable scroll and the first housing, wherein the vibration isolator is made of a vibration absorbing material and is capable of absorbing vibrations generated at the movable scroll to thereby prevent transfer of the vibrations from the movable scroll to the mounting member via the first housing.

11 Claims, 5 Drawing Sheets

(56) References Cited

U.S. PATENT DOCUMENTS

| | | | | |
|---|---|---|---|---|
| 2008/0232990 | A1 | 9/2008 | Reinhart | |
| 2009/0155101 | A1 | 6/2009 | Fukasaku et al. | |
| 2010/0260629 | A1 * | 10/2010 | Kang et al. | 417/417 |

FOREIGN PATENT DOCUMENTS

| | | | |
|---|---|---|---|
| CN | 1771395 | A | 5/2006 |
| CN | 101636588 | A | 1/2010 |
| EP | 1059452 | A1 | 12/2000 |
| EP | 1555437 | A1 | 7/2005 |
| EP | 2072754 | A2 | 6/2009 |
| JP | 61-197782 | A | 9/1986 |
| JP | 62-156663 | U | 10/1987 |
| JP | 08-144979 | A | 6/1996 |
| JP | 62-121887 | A | 6/1996 |
| JP | 10-122166 | A | 5/1998 |
| JP | 2009-293523 | A | 12/2009 |
| WO | 2004/104421 | A1 | 12/2004 |

OTHER PUBLICATIONS

Damping Properties of Materials. Webpage [online], Nov. 8, 2014 [retrieved on Dec. 14, 2014]. Retrieved from the Internet: <URL: syont.files.wordpress.com2007/05/damping-properties-of materi-als.pdf>.*

English Machine Translation of JP 08-144979 A (translated on Apr. 15, 2015).*

Chinese Office Action dated Mar. 10, 2014 issued in corresponding Chinese Patent Application No. 201210063903.5.

Communication dated Feb. 19, 2016, from the European Patent Office in counterpart European Application No. 12158531.9.

* cited by examiner

VEHICULAR SCROLL COMPRESSOR HAVING HOUSING ARRANGEMENTS FOR IMPROVED VIBRATION ISOLATION

BACKGROUND OF THE INVENTION

1. Field of the Invention

The present invention relates to a scroll-type compressor for a vehicle.

2. Description of the Related Art

Japanese Laid-open Patent Publication No. 2009-293523 discloses a conventional scroll-type compressor for a vehicle. The compressor includes a housing, a fixed scroll and a movable scroll provided in the housing, and a drive mechanism that is provided in the housing to drive the movable scroll by rotation of a drive shaft such that the movable scroll is disabled from rotating and enabled for orbit. The compressor also includes in the housing a motor mechanism capable of rotating the drive shaft.

In the compressor, the housing is configured to have a motor housing, a bearing support member, and a compressor housing. The motor housing holds a front bearing device and supports a front end of the drive shaft by the front bearing device. The motor housing is integrated with a mounting member to be coupled to a vehicle. The motor housing includes an inner peripheral surface having a plurality of seat surfaces extending in a direction perpendicular to a rotation axis of the drive shaft, and the bearing support member is tightened and fixed with bolts in an axial direction to the seat surfaces via a vibration-isolating material in the form of a thin sheet. The bearing support member holds a rear bearing device which supports a rear end of the drive shaft. The compressor housing is fixed with a bolt in the axial direction to the motor housing. The fixed scroll is fixed to the compressor housing with a bolt. In addition, the movable scroll is arranged between the bearing support member and the fixed scroll.

In this compressor, when the drive shaft is rotated by the motor mechanism, the movable scroll revolves in cooperation with the drive mechanism. Accordingly, a compressor chamber between the fixed scroll and the movable scroll gradually decreases in volume, which makes it possible to compress a refrigerant in the compression chamber. During such operation, the vibration-isolating material in the form of a thin-sheet attenuates vibrations of the drive shaft, to thereby suppress vibrations of the motor housing, and eventually vibrations of the entire compressor.

SUMMARY OF THE INVENTION

However, it is considered that the foregoing scroll-type compressor cannot reduce noise sufficiently due to the cause described below.

Specifically, in scroll-type compressors, vibrations are not always generated by a drive shaft but may be generated by a force acting on a compression chamber due to, for example, collision between a movable scroll and a fixed scroll.

In this respect, the foregoing scroll-type compressor has a vibration-isolating material in the form of a thin sheet between the seat surfaces of the motor housing and the bearing support member.

However, in this scroll-type compressor, the entire bearing support member is made of a metal with a low degree of vibration absorption, and the motor housing and the bearing support member are fixed with a bolt, whereby vibrations of the bearing support member are likely to be transferred to the motor housing via the metallic bolts. Accordingly, the entire scroll-type compressor vibrates and causes noise to remain with a vehicle equipped with the scroll-type compressor.

An object of the present invention is to provide a scroll-type compressor for a vehicle that is made more excellent in quietness.

In one aspect of the invention, a scroll-type compressor for a vehicle, comprising a housing, a fixed scroll and a movable scroll provided in the housing, and a drive mechanism that is provided in the housing and that drives the movable scroll in a manner that disables rotating and enables orbit, by rotation of a drive shaft supported at a front end and a rear end by a front bearing device and a rear bearing device, is provided. The housing includes: a first housing that holds the front bearing device and supports a front end of the drive shaft by the front bearing device, the first housing being provided with a mounting member to be coupled to the vehicle; a second housing that is fixed to the first housing, wherein the second housing holds the rear bearing device and supports a rear end of the drive shaft by the rear bearing device; and a third housing that is fixed to the first housing, wherein the third housing places the movable scroll between the second housing and the fixed scroll, and fixes the fixed scroll together with the second housing. The compressor includes a vibration isolator that is provided between the movable scroll and the first housing, wherein the vibration isolator is made of a vibration absorbing material and is capable of absorbing vibrations generated at the movable scroll to thereby prevent transfer of the vibrations from the movable scroll to the mounting member via the first housing.

BRIEF DESCRIPTION OF THE INVENTION

DESCRIPTION OF THE PREFERRED EMBODIMENTS

A motor-driven scroll-type compressor for a vehicle of the invention will be described in accordance with Embodiments 1 to 4 with reference to the drawings.

Embodiment 1

Figure 1:
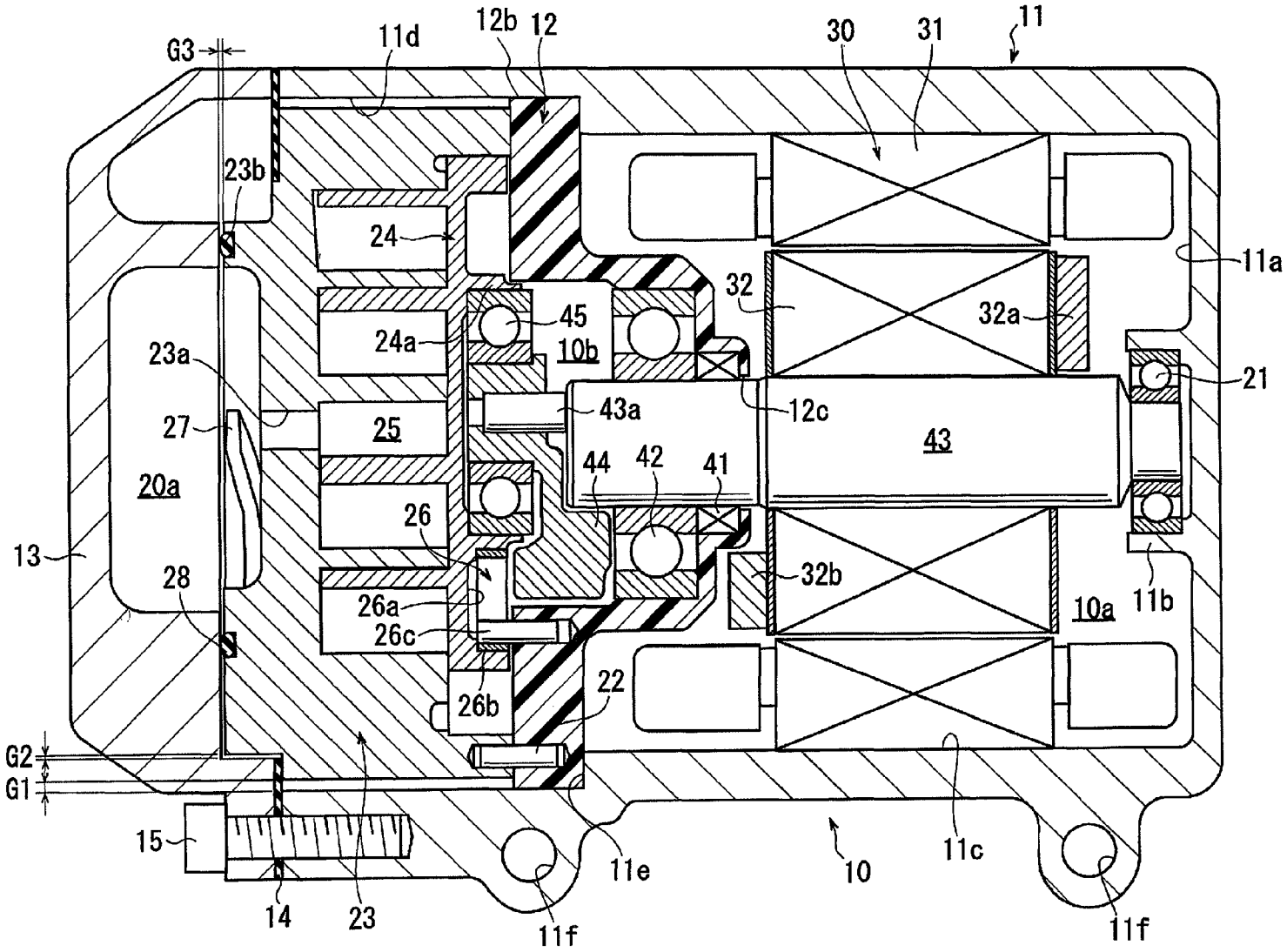
FIG. 1 is a cross-section view of a motor-driven scroll-type compressor for a vehicle of Embodiment 1.

A motor-driven scroll-type compressor for a vehicle of Embodiment 1 includes a housing 10 as illustrated in FIG. 1. The housing 10 includes a cup-shaped first housing 11 opened on the side of a rear end, an annular second housing 12 housed in the first housing 11, and a lid-shaped third housing 13 that closes the rear end of the first housing 11. Throughout the drawings, the right side is denoted as the front and the left side is denoted as the rear.

The first housing 11 is integrated with a plurality of mounting members 11*f* to be coupled to the vehicle. The first housing 11 has, on its inner bottom surface 11*a*, a boss 11*b* extending rearward in the form of a cylinder. A front bearing device 21 is fixed in the boss 11*b*. The first housing 11 has a cylindrical inner peripheral surface 11*c* located close to the inner bottom surface 11*a* and has a cylindrical inner peripheral surface 11*d* located distant from the inner bottom surface 11*a*. The inner peripheral surface 11*c* and the inner peripheral surface 11*d* are coaxially arranged, but the inner peripheral surface 11*d* is larger in diameter than the inner peripheral surface 11*c*. The inner peripheral surface 11*c* and the inner peripheral surface 11*d* are made continuous via a fixed surface 11*e* extending in a direction perpendicular to a rotation axis of the drive shaft. A stator 31 of the motor mechanism 30 is fixed to the inner peripheral surface 11*c*. The stator 31 is supplied with three-phase current from a non-illustrated drive circuit.

The second housing 12 is entirely made of a vibration absorbing material as a vibration isolator, which is the most characteristic arrangement in this embodiment. Specifically, the second housing 12 is made of plastic or resin. The second housing 12 is housed in the first housing 11 in such a manner that an outer peripheral surface 12*b* of the second housing 12 is fitted loosely with a clearance to the inner peripheral surface 11*d* of the first housing 11.

The second housing 12 has a central part which projects forward and has a shaft hole 12*c* at the center thereof. Behind the shaft hole 12*c*, a shaft seal device 41 and a rear bearing device 42 are fixed to the second housing 12. The drive shaft 43 is rotatably supported at its frond end by the frond-end bearing device 21, and is rotatably supported at its rear end by the rear bearing device 42. The shaft seal device 41 is in sliding contact with the drive shaft 43 to separate a motor chamber 10*a* on the frond side of the shaft seal device 41 and a back-pressure chamber 10*b* on the rear side of the shaft seal device 41. The motor chamber 10*a* also serves as an intake chamber having a non-illustrated intake opening.

A rotor 32 is fixed to the drive shaft 43 in the motor chamber 10*a*. The rotor 32 is rotated in the stator 31 by a current supplied to the stator 31. Weights 32*a* and 32*b* for eliminating unbalanced rotation are fixed in front and rear of the rotor 32. The drive shaft 43, the stator 31, and the rotor 32 form the motor mechanism 30.

A fixed scroll 23 is fixed to the second housing 12 by a plurality of pins 22. A movable scroll 24 is arranged between the second housing 12 and the fixed scroll 23. The fixed scroll 23 and the movable scroll 24 are made of metal. The fixed scroll 23 and the movable scroll 24 engage with each other to form a compression chamber 25 between the scrolls 23, 24.

A cylindrical boss 24*a* projects forward at the center of a front surface of the movable scroll 24. A plurality of rotation prevention holes 26*a* are recessed in an outer peripheral area of the front surface of the movable scroll 24. A rotation prevention ring 26*b* is provided to each rotation prevention hole 26*a*. A plurality of rotation prevention pins 26*c* are provided to project rearward on a rear surface of the second housing 12. Each rotation prevention pin 26*c* rotates in the corresponding rotation prevention ring 26*b*. The rotation prevention holes 26*a*, the rotation prevention rings 26*b*, and the rotation prevention pins 26*c* form a rotation prevention mechanism 26.

An eccentric pin 43*a* projects from a rear end of the drive shaft 43. The eccentric pin 43*a* is rotatably inserted into a balancer-equipped bush 44. A bearing device 45 is provided between a cylindrical part of the balancer-equipped bush 44 and the boss 24*a* of the movable scroll 24. The eccentric pin 43*a*, the balancer-equipped bush 44, the bearing device 45, and the rotation prevention mechanism 26 form a drive mechanism.

Figure 2:
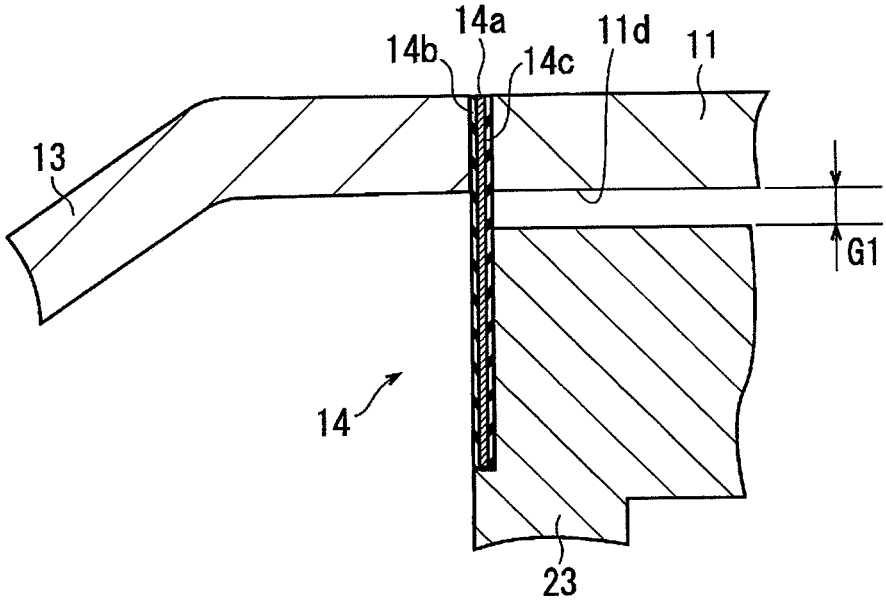
FIG. 2 is a partially enlarged cross-section view of the motor-driven scroll-type compressor of Embodiment 1.

The third housing 13 is tightened and fixed in an axial direction to a rear end of the first housing 11 by a plurality of bolts 15 via a gasket 14. The gasket 14 includes a metallic substrate 14*a* and rubbers 14*b* and 14*c* integrated into front and rear sides of the substrate 14*a*, as illustrated in FIG. 2. The rubbers 14*b* and 14*c* are elastic bodies.

As illustrated in FIG. 1, the third housing 13 forms a discharge chamber 20*a* together with the fixed scroll 23. The discharge chamber 20*a* has a non-illustrated discharge port. In addition, the discharge chamber 20*a* is connected to the back-pressure chamber 10*b* by a non-illustrated path. The fixed scroll 23 has a discharge hole 23*a* to connect the compression chamber 25 to the discharge chamber 20*a*. A non-illustrated discharge reed valve for opening and closing the discharge hole 23*a*, and a retainer 27 for regulating the opening of the discharge reed valve are fixed to a rear end surface of the fixed scroll 23. A ring groove 23*b* is recessed at a portion of the rear end surface of the fixed scroll 23 which opposes to the third housing 13. An O-ring 28 as an elastic body is provided in the ring groove 23*b*.

As illustrated in FIGS. 1 and 2, a radial gap G1 exists between the fixed scroll 23 and the first housing 11. In addition, as illustrated in FIG. 1, a radial gap G2 exists between the fixed scroll 23 and the third housing 13. Since the third housing 13 is tightened via the gasket 14 to the first housing 11 and the O-ring 28 is provided between the fixed scroll 23 and the third housing 13, the fixed scroll 23 is elastically supported in the axial direction together with the second housing 12 by the first housing 11 and the third housing 13. An axial gap G3 exists between the fixed scroll 23 and the third housing 13.

The motor chamber 10*a* is connected to a non-illustrated evaporator by a pipe connected to an intake opening. The evaporator is connected by a pipe to an expansion valve, and the expansion valve is connected by a pipe to a condenser. The discharge chamber 20*a* is connected to the condenser by a pipe connected to the discharge port. The compressor, the evaporator, the expansion valve, and the condenser form a refrigerant circuit of an air-conditioner for a vehicle.

In the compressor, when a driver of the vehicle operates the air-conditioner, the motor mechanism 30 rotates the rotor 32. This rotates the drive shaft 43 to turn the eccentric pin 43*a*. Accordingly, the movable scroll 24 revolves around the rotation axis of the drive shaft 43, in cooperation with the balancer-equipped bush 44, the bearing device 45, and the rotation prevention mechanism 26. This gradually reduces the compression chamber 25 in volume, whereby a refrigerant in the evaporator can be sucked from the motor chamber 10*a* into the compression chamber 25 and compressed in the compression chamber 25. The refrigerant compressed to a discharge pressure in the compression chamber 25 is discharged from the discharge hole 23*a* to the discharge chamber 20*a*, and then is discharged into the condenser.

During such an operation, vibrations occur in the compressor due to a force acting on the compression chamber 25. These vibrations are generated, for example, by collision between the movable scroll 24 and the fixed scroll 23.

With regard to this aspect, in the compressor, the housing 10 has the first housing 11, the second housing 12, and the third housing 13. In addition, the second housing 12 is made of plastic or resin. Accordingly, vibrations generated at the movable scroll 24 and transferred to the second housing 12 through the drive mechanism, the drive shaft 43, and the rear bearing device 42, are absorbed in the entire second housing 12 and are less prone to be transferred to the first housing 11. Specifically, since the second housing 12 made of a vibration absorbing material is intervened in a vibration transfer path from the movable scroll 24 to the mounting members 11*f*, vibrations are less prone to be transferred to the first housing 11, thereby preventing transfer of vibrations to the vehicle. In the compressor, since the second housing 12 is made of plastic or resin, vibrations from the rotation prevention mechanism 26 are also absorbed by the entire second housing 12 and are less prone to be transferred to the first housing 11.

Further, in the compressor, the fixed scroll 23 is elastically supported in the axial direction between the first housing 11 and the third housing 13 and the second housing 12 exists between the fixed scroll 23 and the first housing 11. Therefore, if the fixed scroll 23 vibrates, vibrations of the fixed scroll 23 are less prone to be transferred to the first housing 11. In particular, since the O-ring 28 exists between the fixed scroll 23 and the third housing 13, a gap is provided between the fixed scroll 23 and the third housing 13. Thus vibrations of the fixed scroll 23 are less prone to be transferred to the third housing 13. In addition, since the gasket 14 exists between the third housing and the first housing 11, vibrations of the housings are absorbed by the gasket 14, and thus less prone to be transferred to the first housing 11.

In this case, since an interior of the discharge chamber is under a high pressure, the fixed scroll can be elastically supported in an easy manner in the axial direction between the first housing and the third housing, and hence the discharge chamber can be sealed by the O-ring.

In addition, in the compressor, the fixed scroll 23 and the movable scroll 24 are made of metal. Therefore, vibrations are prone to be transferred, whereas mechanical strength and thermal strength can be achieved.

In addition, gaps G1 to G3 are provided between the fixed scroll 23 and the first housing 11 and between the fixed scroll 23 and the third housing 13. Accordingly, even if the fixed scroll 23 vibrates, such vibrations are less prone to be transferred to the first housing 11 and the third housing 13 because of the gaps G1 to G3.

Therefore, according to this compressor of this embodiment, transfer from it is prevented in that vibrations generated at the movable scroll 24 are transferred to the vehicle via the mounting members 11*f*, thereby allowing the vehicle to exhibit excellent quiet performance.

In particular, the compressor is configured such that the housing 10 includes the motor mechanism 30 and the drive shaft 43 is rotatable by the motor mechanism 30. Since such a compressor may be driven even when the engine is stopped, vibrations transferred to the housing are likely to be recognized as noise, whereas a compressor including a drive shaft coupled to an engine is not driven during engine stoppage period. Therefore, the advantage of quietness of the invention is remarkably recognizable.

Embodiment 2

Figure 3:
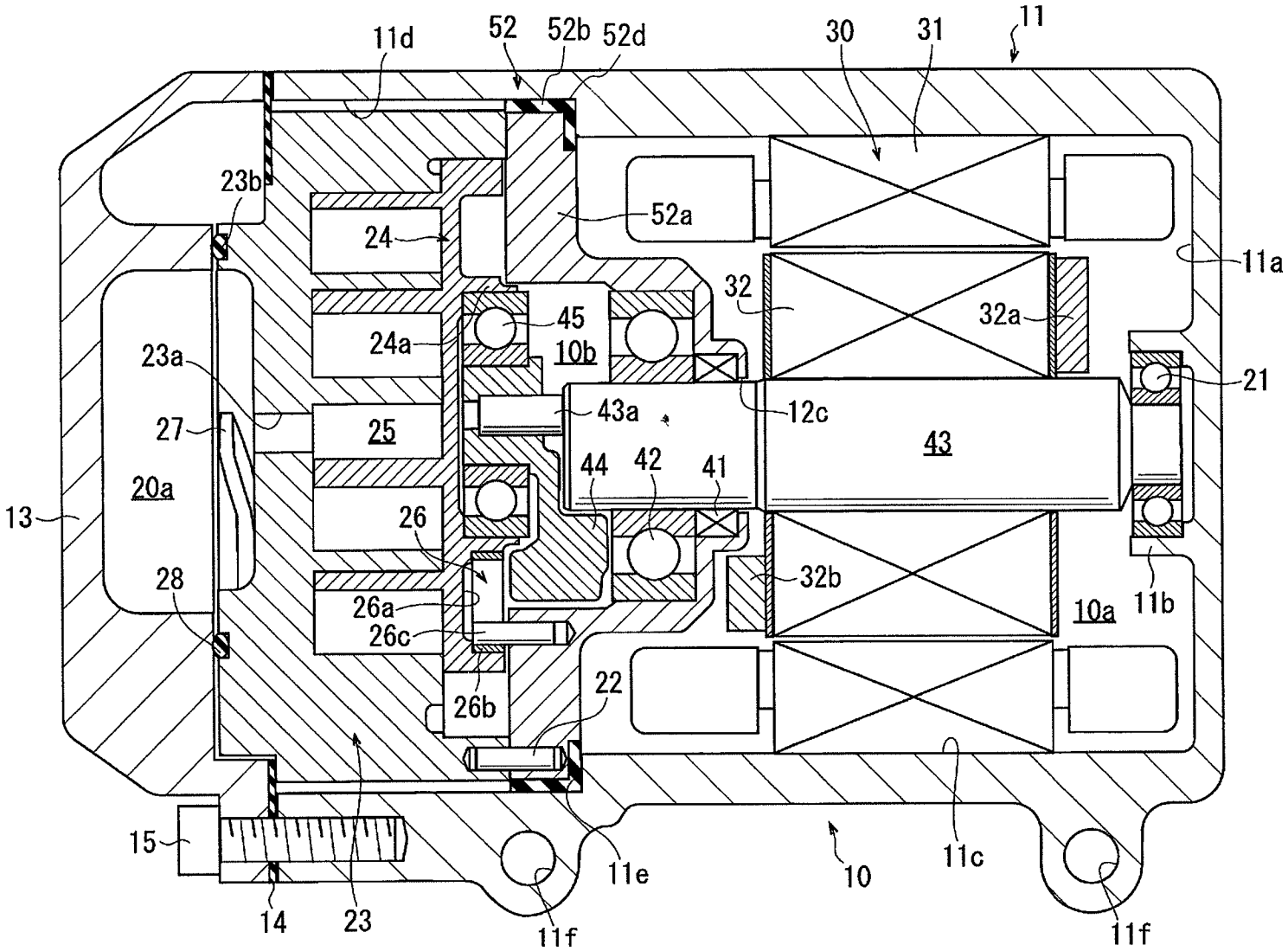
FIG. 3 is a cross-section view of a motor-driven scroll-type compressor of Embodiment 2.

A motor-driven scroll-type compressor for a vehicle of Embodiment 2 includes a second housing 52 different from that in the compressor of Embodiment 1, as illustrated in FIG. 3. The second housing 52 includes a metallic main body 52*a* holding a rear bearing device 42 and a vibration-isolating member 52*b* made of a vibration absorbing material integrally provided on an outer periphery of the main body 52*a*. The vibration-isolating member 52*b* is a vibration isolator provided between the main body 52*a* and the first housing 11. Specifically, the vibration-isolating member 52*b* is made of plastic or resin.

The second housing 52 is housed in the first housing 11 in such a manner that an outer peripheral surface 52*d* of the second housing 52 is fitted loosely with a clearance relative to the inner peripheral surface 11*d* of the first housing 11.

In this compressor, vibrations transferred to the main body 52*a* in the second housing 52 are absorbed by the vibration-isolating member 52*b*, and thus are less prone to be transferred to the first housing 11. Other advantages of this embodiment are the same as those of Embodiment 1.

Embodiment 3

Figure 4:
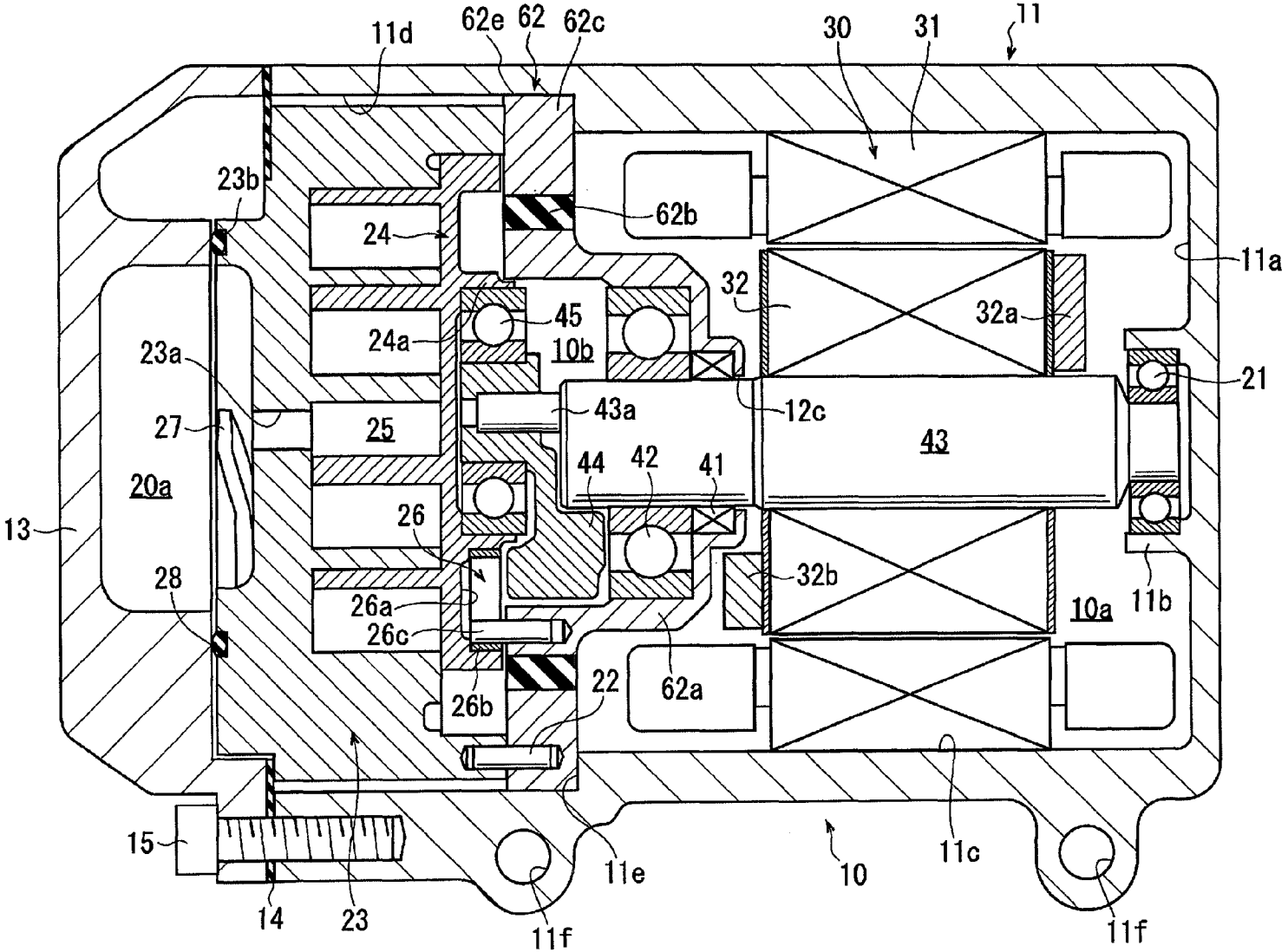
FIG. 4 is a cross-section view of a motor-driven scroll-type compressor of Embodiment 3.

A motor-driven scroll-type compressor for a vehicle of Embodiment 3 includes a second housing 62 different from those of Embodiments 1 and 2, as illustrated in FIG. 4. The second housing 62 includes a metallic first main body 62*a*, a vibration-isolating member 62*b* and a metallic second main body 62*c*. The metallic first main body 62*a* holds the rear bearing device 42. The vibration-isolating member 62*b* is made of a vibration absorbing material and is integrated with an outer peripheral side of the first main body 62*a*. The metallic second main body 62*c* is integrated with a radial outside or an outer peripheral side of the vibration-isolating member 62*b* and is provided between the second housing 62 and the first housing 11. The vibration-isolating member 62*b* is a vibration isolator provided between the first main body 62*a* and the second main body 62*c*. Specifically, the vibration-isolating member 62*b* is also made of plastic or resin. The rotation prevention pins 26*c* of the rotation prevention mechanism 26 are fixed to the first main body 62*a*, and the vibration isolating member 62*b* is located at an outside of the rotation prevention pins 26*c*.

The second housing 62 is housed in the first housing 11 in such a manner that an outer peripheral surface 62*e* is fitted loosely with a clearance to the inner peripheral surface 11*d* of the first housing 11.

In this compressor, vibrations transferred to the first main body 62*a* of the second housing 62 are absorbed by the vibration-isolating member 62*b* and thus are less prone to be transferred to the second main body 62*d* and the first housing 11. Other advantages of this embodiment are the same as those of Embodiment 1.

Embodiment 4

Figure 5:
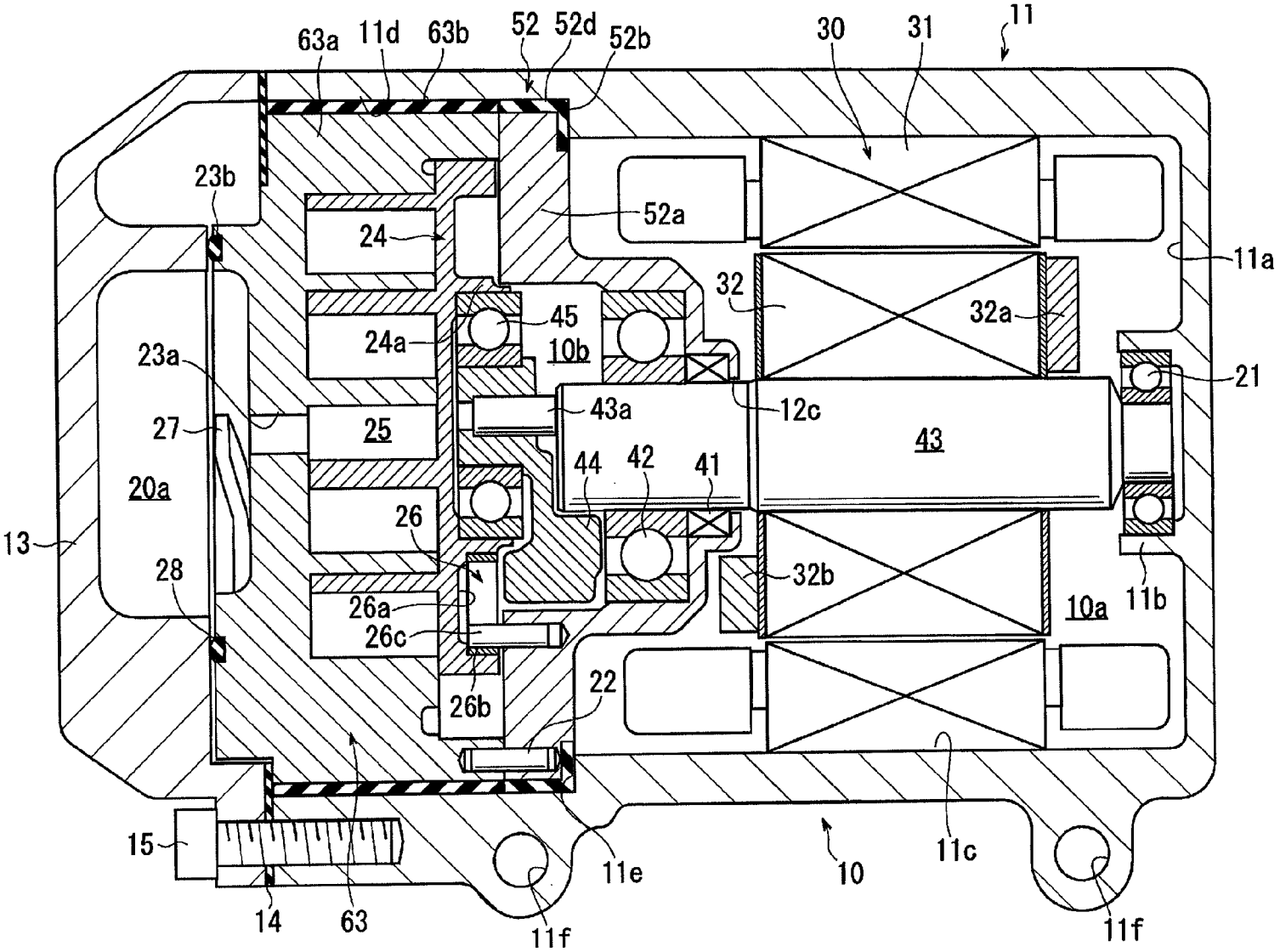
FIG. 5 is a cross-section view of a motor-driven scroll-type compressor of Embodiment 4.

A motor-driven scroll-type compressor of Embodiment 4 includes the second housing 52 that is the same as that in the compressor of Embodiment 2, and includes a fixed scroll 63 different from those in the compressors of Embodiments 1 to 3, as illustrated in FIG. 5.

The fixed scroll 63 includes a metallic fixed scroll main body 63*a* engaging with the movable scroll 24 and a vibration-isolating member 63*b* provided between the fixed scroll main body 63*a* and the first housing 11. The vibration-isolating member 63*b* is a vibration isolator. Specifically, the vibration-isolating member 63*b* is also made of plastic or resin.

In this compressor, even though the fixed scroll main body 63*a* vibrates due to collision with the movable scroll 24, such vibrations are absorbed by the vibration-isolating member 63*b* and thus are less prone to be transferred to the third housing 13 and the first housing 11. Other advantages of this embodiment are the same as those of Embodiment 2.

In the foregoing, the present invention has been described with regard to Embodiments 1 to 4. However, it should be understood that the present invention is not limited to Embodiments 1 to 4, and can be modified and applied as appropriate without departing from the gist of the invention.

For example, in Embodiment 4, the second housing 12 of Embodiment 1 or the second housing 62 of Embodiment 3 can be employed in place of the second housing 52 of Embodiment 2.

In addition, the mounting members 11*f* may not be integrated with the first housing 11 but may be fixed to the first housing 11 as a separate member.

The vibration absorbing material needs a certain degree of stiffness because vibration absorbing material is intended to allow the second housing 12 to hold the rear bearing device 42 and allow the rear bearing device 42 to support the rear end of the drive shaft 43. However, the vibration absorbing material may not be plastic or resin but may be FRP, rubber, elastomer, vibration damping metal, or the like.

The vibration absorbing material can be selected in accordance with a refrigerant environment or a vibration frequency in a place where the vibration-isolating member is provided.

The drive mechanism can be any of various types, provided that the drive mechanism can drive the movable scroll in such a manner as to revolve around the drive shaft by rotation of the drive shaft. The bush and the balancer may be separately provided.

The present invention can be applied to air-conditioners, for example, in hybrid automobiles, electric cars, and the like.

What is claimed is:

1. A scroll compressor for a vehicle, comprising:

a housing, a fixed scroll, and a movable scroll provided in the housing;

a motor mechanism including a drive shaft, a stator, and a rotor, said motor mechanism being configured to rotate the drive shaft; and a drive mechanism including an eccentric pin, a balancer-equipped bush, and a bearing device, said drive mechanism being provided in the housing to operably connect with the movable scroll via the drive shaft and that is configured to disable rotation of the movable scroll in a manner that enables orbit of the movable scroll, by rotation of the drive shaft, the drive shaft being supported at a front end and a rear end by a front bearing device and a rear bearing device, respectively, wherein the housing includes:

a first housing that holds the front bearing device and supports the front end of the drive shaft by the front bearing device, the first housing being provided with a mounting member configured to couple to the vehicle, and the motor mechanism being disposed inside the first housing;

a second housing that is fitted to the first housing, the second housing being formed from a combination of two distinct non-admixed materials, said two materials including a first material and a second material different from the first material and the first material forms a majority portion of the second housing and the second material forms a minority portion of the second housing, and the second housing further holds the rear bearing device that supports the rear end of the drive shaft; and a third housing that is fixed to the first housing, wherein the third housing cooperates with the second housing to position the fixed scroll between the second and the third housings with the movable scroll placed between the second housing and the fixed scroll, and the fixed scroll further being fixed to the second housing, wherein the first material is metal, and the second material is one of plastic or resin, wherein the second housing has an outer peripheral edge facing radially outward with respect to the drive shaft, and the second material is disposed at the outer peripheral edge in a manner such that when the second housing is fitted in the first housing, the second material disposed at the outer peripheral edge engagingly contacts the first housing.

2. The scroll compressor for the vehicle according to claim 1, wherein the fixed scroll includes a metallic fixed scroll main body engaged with the movable scroll and a vibration-isolating member made of one of a plastic or resin material, the vibration-isolating member provided between an outer peripheral surface of the metallic fixed scroll main body and an inner peripheral surface of the first housing, so as to be adjacent to the minority portion of the second housing.

3. The scroll compressor for the vehicle according to claim 1, wherein the fixed scroll is elastically supported in an axial direction together with the second housing by the first housing and the third housing.

4. The scroll compressor for the vehicle according to claim 3, wherein, the first housing is formed in the shape of a cup having an inner peripheral surface holding the motor mechanism and an inner bottom surface holding the front bearing device, the second housing is disposed in the first housing, and the third housing forms a discharge chamber together with the fixed scroll and closes the first housing.

5. The scroll compressor for the vehicle according to claim 4, wherein a gap is provided between an outer peripheral surface of the fixed scroll and an inner peripheral surface of the first housing and between an axial end surface of the fixed scroll and the third housing.

6. The scroll compressor for the vehicle according to claim 5, wherein an elastic body is provided between, and in contact with, the fixed scroll and the third housing, and a gasket is provided between, and in contact with, the first housing and the third housing.

7. The scroll compressor for the vehicle according to claim 1, wherein the movable scroll is made of metal.

8. The scroll compressor for the vehicle according to claim 1, further comprising a plurality of pins that fix the fixed scroll directly to the majority portion of the second housing.

9. The scroll compressor for the vehicle according to claim 1, wherein at least a portion of the minority portion extends along a same direction as an axial direction of the drive shaft.

10. A scroll compressor for a vehicle, comprising:

a housing, a fixed scroll, and a movable scroll provided in the housing;

a motor mechanism including a drive shaft, a stator, and a rotor, said motor mechanism being configured to rotate the drive shaft; and a drive mechanism including an eccentric pin, a balancer-equipped bush, and a bearing device, said drive mechanism being provided in the housing to operably connect with the movable scroll via the drive shaft and that is configured to disable rotation of the movable scroll in a manner that enables orbit of the movable scroll, by rotation of the drive shaft, the drive shaft being supported at a front end and a rear end by a front bearing device and a rear bearing device, respectively, wherein the housing includes:

a first housing that holds the front bearing device and supports the front end of the drive shaft by the front bearing device, the first housing being provided with a mounting member configured to couple to the vehicle, and the motor mechanism being disposed inside the first housing;

a second housing that is fitted to the first housing, the second housing being formed from a combination of two distinct non-admixed materials, said two materials including a first material and a second material different from the first material and the first material forms a majority portion of the second housing and the second material forms a minority portion of the second housing, and the second housing further holds the rear bearing device that supports the rear end of the drive shaft; and a third housing that is fixed to the first housing, wherein the third housing cooperates with the second housing to position the fixed scroll between the second and the third housings with the movable scroll placed between the second housing and the fixed scroll, and the fixed scroll further being fixed to the second housing, wherein the first material is metal, and the second material is one of plastic or resin, wherein:

the majority portion includes a first main body and a second main body, the first main body holding the rear bearing device, and the second main body being disposed radially outward from the first main body;

the minority portion provided on an outer peripheral surface of the first main body so as to be disposed between the outer peripheral surface of the first main body and an inner peripheral surface of the second main body; and the second main body is provided between an outer peripheral surface of the minority portion and an inner peripheral surface of the first housing.

11. A scroll compressor for a vehicle, comprising:

a housing, a fixed scroll, and a movable scroll provided in the housing;

a motor mechanism including a drive shaft, a stator, and a rotor, said motor mechanism being configured to rotate the drive shaft; and a drive mechanism including an eccentric pin, a balancer-equipped bush, and a bearing device, said drive mechanism being provided in the housing to operably connect with the movable scroll via the drive shaft and that is configured to disable rotation of the movable scroll in a manner that enables orbit of the movable scroll, by rotation of the drive shaft, the drive shaft being supported at a front end and a rear end by a front bearing device and a rear bearing device, respectively, wherein the housing includes:

a first housing that holds the front bearing device and supports the front end of the drive shaft by the front bearing device, the first housing being provided with a mounting member configured to couple to the vehicle, and the motor mechanism being disposed inside the first housing;

a second housing that is fitted to the first housing, the second housing being formed from a combination of two distinct non-admixed materials, said two materials including a first material and a second material different from the first material and the first material forms a majority portion of the second housing and the second material forms a minority portion of the second housing, and the second housing further holds the rear bearing device that supports the rear end of the drive shaft; and a third housing that is fixed to the first housing, wherein the third housing cooperates with the second housing to position the fixed scroll between the second and the third housings with the movable scroll placed between the second housing and the fixed scroll, and the fixed scroll further being fixed to the second housing, wherein the first material is metal, and the second material is one of plastic or resin, wherein the fixed scroll includes a metallic fixed scroll main body engaged with the movable scroll and a vibration-isolating member made of one of a plastic or resin material, the vibration-isolating member provided between an outer peripheral surface of the metallic fixed scroll main body and an inner peripheral surface of the first housing, so as to be adjacent to the minority portion of the second housing.

* * * * *